US010792533B2

(12) United States Patent
Sorum

(10) Patent No.: US 10,792,533 B2
(45) Date of Patent: Oct. 6, 2020

(54) WEIGHT BENCH TILT LOCKING MECHANISM SYSTEM AND APPARATUS

(71) Applicant: William Sorum, Barrington, IL (US)

(72) Inventor: William Sorum, Barrington, IL (US)

(73) Assignee: SOOL CORP, Barrington, IL (US)

( * ) Notice: Subject to any disclaimer, the term of this patent is extended or adjusted under 35 U.S.C. 154(b) by 0 days.

(21) Appl. No.: 16/360,478

(22) Filed: Mar. 21, 2019

(65) Prior Publication Data

US 2019/0290954 A1 Sep. 26, 2019

Related U.S. Application Data

(60) Provisional application No. 62/647,880, filed on Mar. 26, 2018.

(51) Int. Cl.
*A63B 21/00* (2006.01)
*A63B 21/078* (2006.01)

(52) U.S. Cl.
CPC ..... *A63B 21/4029* (2015.10); *A63B 21/078* (2013.01); *A63B 21/4047* (2015.10)

(58) Field of Classification Search
CPC ..... A63B 21/0615; A63B 21/0616; A63B 21/0617; A63B 21/062; A63B 21/0622; A63B 21/0624; A63B 21/0626; A63B 21/078; A63B 21/15; A63B 21/159; A63B 21/4027; A63B 21/4029; A63B 21/4045; A63B 21/4047; A63B 21/4049; A63B 22/0015; A63B 22/0017; A63B 22/0023; A63B 22/0046; A63B 69/0057; A63B 71/0036; A63B 2208/0242; A63B 2208/0252; A63B 2210/00; A63B 2210/50; A63B 2225/09; A63B 2225/093; A63B 2244/09
See application file for complete search history.

(56) References Cited

U.S. PATENT DOCUMENTS 3,342,485 A * 9/1967 Gaul ..... A63B 21/4029 482/145
4,316,609 A * 2/1982 Silberman ..... A63B 21/4031 482/102
4,382,596 A * 5/1983 Silberman ..... A63B 21/154 482/102
4,492,375 A * 1/1985 Connelly ..... A63B 21/055 482/130
4,564,193 A * 1/1986 Stewart ..... A63B 21/06 482/102
4,598,908 A * 7/1986 Morgan ..... A63B 21/0724 482/104
4,635,934 A * 1/1987 Roethke ..... A63B 21/154 482/104

(Continued)

*Primary Examiner* — Gary D Urbiel Goldner
(74) *Attorney, Agent, or Firm* — Justin Lampel

(57) ABSTRACT

A weight bench tilt locking mechanism system and apparatus is provided. The tilt locking mechanism allows a single lever to simultaneously release two pins which are temporarily secured to two respective movable support bars which hold a bench portion of a weight bench in place. The tilt locking mechanism allows the weight bench to be selectively secured at various angles so as to allow a user to work out various muscles of his/her body. The tilt locking mechanism further allows the weight bench to be folded in a compact manner for storage while the system and apparatus is not in use.

12 Claims, 7 Drawing Sheets

(56) References Cited

U.S. PATENT DOCUMENTS 4,641,837 A * 2/1987 Ruth ..... A63B 21/4029 297/377
4,645,196 A * 2/1987 Christie ..... A63B 21/078 108/167
4,749,190 A * 6/1988 Jennings ..... A63B 23/00 482/104
4,871,166 A * 10/1989 Sterba ..... A63B 23/00 482/142
4,936,572 A * 6/1990 Desiderio ..... A63B 21/078 248/291.1
5,069,447 A * 12/1991 Snyderman ..... A63B 21/078 482/104
RE34,577 E * 4/1994 Habing ..... A63B 21/06 482/100
5,320,592 A * 6/1994 Olschansky ..... A63B 23/00 482/142
5,350,346 A * 9/1994 Martinez ..... A63B 21/078 482/104
5,570,957 A * 11/1996 Kuly ..... A63B 23/00 384/42
5,649,886 A * 7/1997 Danylieko ..... A63B 21/078 482/104
5,665,038 A * 9/1997 Miller ..... A63B 21/078 482/104
5,672,143 A * 9/1997 Ish, III ..... A63B 23/0494 482/137
5,725,460 A * 3/1998 Marsh ..... A63B 21/078 482/104
D399,543 S * 10/1998 Stevens ..... D21/676
7,465,260 B2 * 12/2008 Hockemeyer ..... A63B 21/078 482/140
9,707,438 B2 * 7/2017 Vorozilchak ..... A63B 21/0724
2002/0169057 A1 * 11/2002 Forcillo ..... A63B 21/4031 482/142
2003/0050157 A1 * 3/2003 Teuscher ..... A63B 21/06 482/142
2005/0148449 A1 * 7/2005 Weir ..... A63B 21/078 482/142
2006/0122045 A1 * 6/2006 Webber ..... A63B 21/4029 482/142
2007/0099777 A1 * 5/2007 Forcillo ..... A63B 21/0616 482/142
2018/0229072 A1 * 8/2018 Staten ..... A63B 23/1218

* cited by examiner

WEIGHT BENCH TILT LOCKING MECHANISM SYSTEM AND APPARATUS

REFERENCE TO RELATED APPLICATIONS

This application claims priority to U.S. Provisional Application No. 62/647,880, which was filed on Mar. 26, 2018, the entire contents of which are incorporated by reference herein.

BACKGROUND OF THE INVENTION

A weight bench tilt locking mechanism system and apparatus is provided. The tilt locking mechanism allows a single lever to simultaneously release two pins which are temporarily secured to two respective movable support bars which hold the bench portion of the weight bench in place. The tilt locking mechanism allows the bench to be selectively secured at various angles so as to allow a user to work out various muscles of his/her body. The tilt locking mechanism further allows the weight bench to be folded in a compact manner for storage while the device is not in use.

Over the years, attempts have been made to provide improved adjustable weight benches. For example, U.S. Pat. No. 9,707,438 to Vorozilchak et al discloses an adjustable weight lifting bench having a frame, a seat pad, and a back pad. The back pad is pivotably coupled to the frame about a first pivot axis and angularly adjustable between a plurality of user-selectable incline and decline positions. A hydraulic mechanism supports the back pad in the incline and decline positions. A movable operating lever operably coupled to the hydraulic mechanism operates to change the mechanism between an activated condition in which the back pad is movable and a deactivated condition in which the back pad locks into a selected one of the positions. When the mechanism is in activated condition, applying pressure against the back pad the lowers the back pad and removing the pressure raises the back pad. In one embodiment, the mechanism automatically raises the back pad when the pressure is removed and the mechanism is in the deactivated condition.

Further, U.S. Pat. No. 5,725,460 to Marsh discloses a bench-type weight support having racks at opposite sides of a bench. The racks support adjustable saddles which receive weights such as dumbbells. The saddles are angularly disposed to provide the proper alignment when grasped by a user from a supine position. In the preferred embodiment, the bench has a seat and a back which are independently adjustable to provide a wide range of exercising positions.

Still further, U.S. Pat. No. 4,641,837 to Ruth discloses an elongated support frame having front and rear ends. The front end supports a seat portion therefrom for adjustable positioning therealong and the rear marginal portion of the seat portion swingably mounts the lower end of an inclined backrest portion therefrom for angular displacement about a horizontal axis extending transversely of the support frame. The upper end of an upstanding prop is pivotally anchored to the upper free swinging end of the backrest portion and anchor structure is mounted from the rear of the support frame for angular displacement relative thereto about a horizontal transverse axis. The anchor structure defines an upstanding sleeve through which the lower end of the prop is slidably received and the sleeve is spaced forward of the axis of rotation of the anchor structure relative to the frame. The sleeve includes internal cam-lock type gripping structure for frictionally gripping the prop against downward shifting of the latter relative to the sleeve but allowing free upward movement of the prop relative to the sleeve. In addition, the gripping structure includes a readily manually engageable release portion whereby the gripping action thereof on the prop may be released, when desired.

However, these patents fail to describe a weight bench tilt locking mechanism which is easy to use and efficient as is described in the present application. A need, therefore, exists for an improved weight bench tilt locking mechanism system and apparatus.

SUMMARY OF THE INVENTION

A weight bench tilt locking mechanism system and apparatus is provided. The tilt locking mechanism allows a single lever to simultaneously release two pins which are temporarily secured to two respective movable support bars which hold the bench portion of the weight bench in place. The tilt locking mechanism allows the bench to be selectively secured at various angles so as to allow a user to work out various muscles of his/her body. The tilt locking mechanism further allows the weight bench to be folded in a compact manner for storage while the device is not in use.

An advantage of the present weight bench tilt locking mechanism system and apparatus is that the present system is easy to use.

Another advantage of the present weight bench tilt locking mechanism system and apparatus is that the present system allows a weight bench to be secured in various selective angles for performing different workouts.

Still another advantage of the present weight bench tilt locking mechanism system and apparatus is that the present system allows the weight bench to be easily folded for storage.

Yet another advantage of the present weight bench tilt locking mechanism system and apparatus is that the present mechanism and system allows a user to simultaneously lock or unlock two securing pins at different locations with one hand.

For a more complete understanding of the above listed features and advantages of the present weight bench tilt locking mechanism system and apparatus reference should be made to the detailed description and the detailed drawings. Further, additional features and advantages of the invention are described in, and will be apparent from, the detailed description of the preferred embodiments.

BRIEF DESCRIPTION OF THE DRAWINGS

FIG. 5 illustrates a side view of the weight bench assembly in some of the possible various positions the bench portion may be secured in.

DETAILED DESCRIPTION OF THE PREFERRED EMBODIMENTS

A weight bench tilt locking mechanism system and apparatus is provided. The tilt locking mechanism allows a single lever to simultaneously release two pins which are temporarily secured to two respective movable support bars which hold the bench portion of the weight bench in place. The tilt locking mechanism allows the bench to be selectively secured at various angles so as to allow a user to work out various muscles of his/her body. The tilt locking mechanism further allows the weight bench to be folded in a compact manner for storage while the device is not in use.

Figure 1:
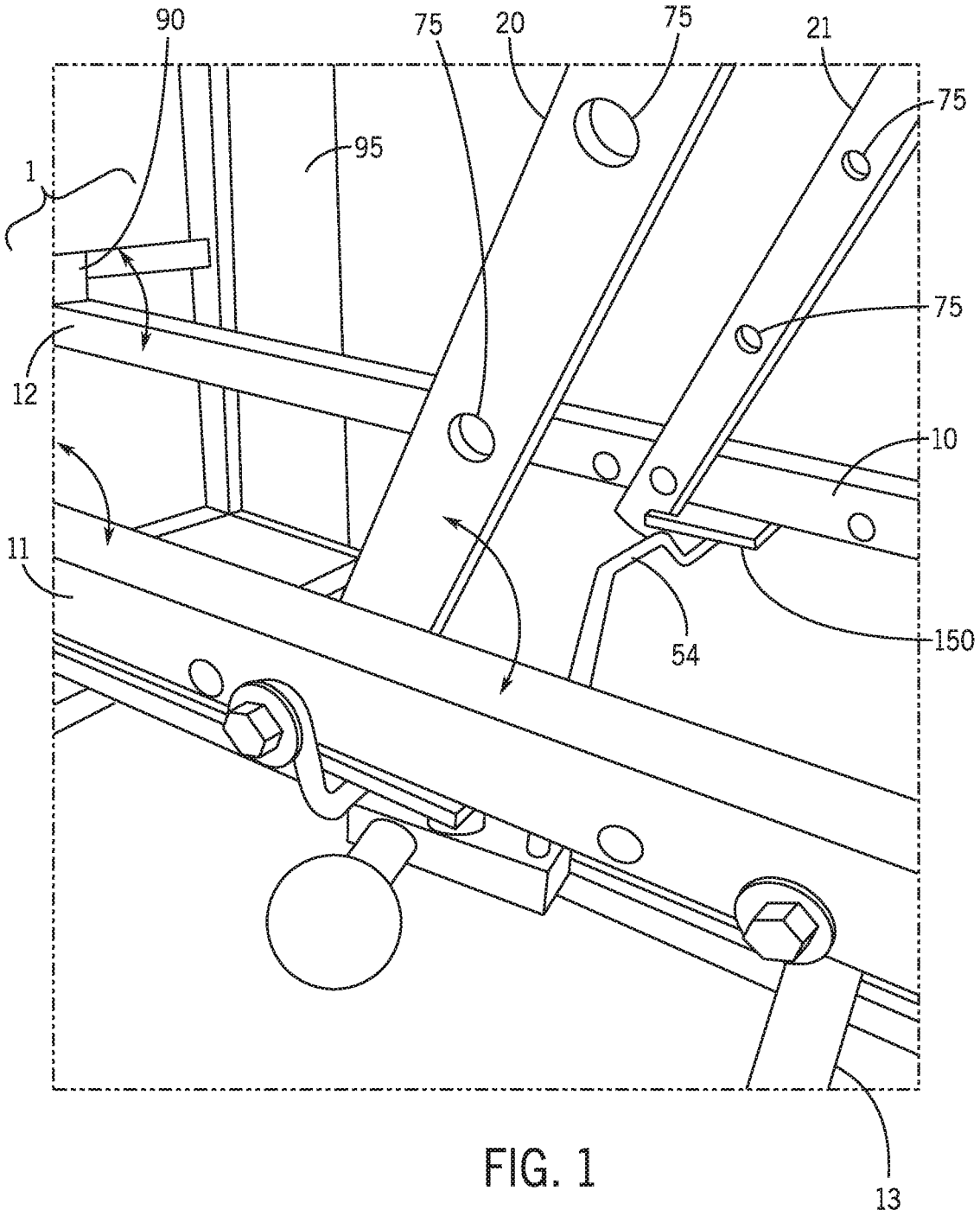
FIG. 1 illustrates a perspective view of the first side of the weight bench having the tilt locking mechanism.
Figure 5:
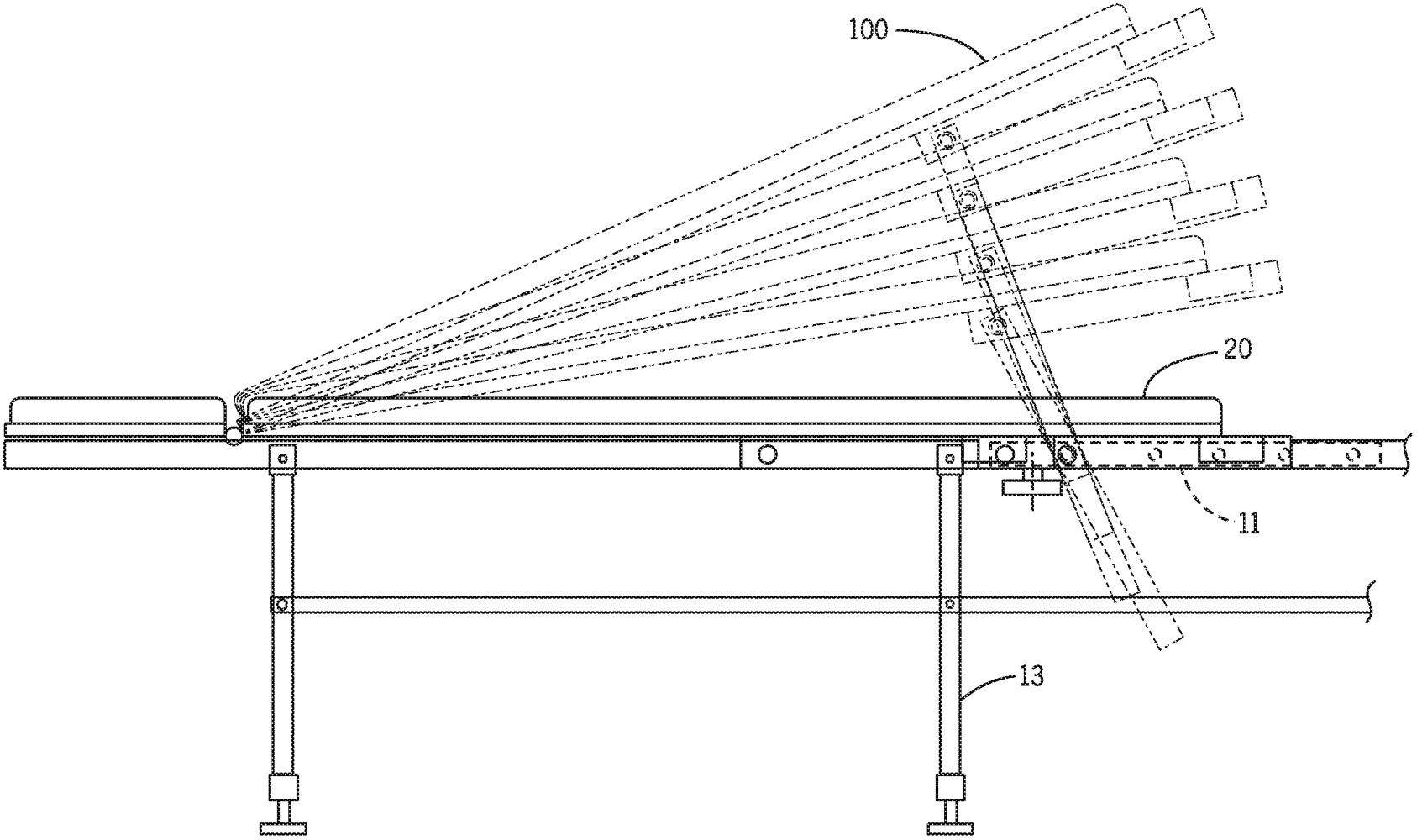

Referring first to FIG. 1, in an embodiment, a weight bench assembly 1 is provided. The weight bench assembly 1 may have a frame 10 which supports a bench 100 (FIG. 5). Preferably, the frame 10 is made of a durable material such as, for example, metal. The frame 10 of the weight bench assembly 1 may have a plurality parts including a first stationary unit 11 a second stationary unit 12 wherein the second stationary unit 12 is parallel to the first stationary unit 11. The weight bench assembly 1 may further have at least one leg bar 13 (FIG. 5) secured to the apparatus 1 wherein the leg bar 13 may pivot from a first orientation (FIG. 1) wherein the device 1 is used to lift weights by a user to a second orientation (FIG. 9) during storage. The leg bar 13 may pivot with respect to the frame 10 by a pin wherein the leg bar 13 may generally be pulled downward (so as to always remain perpendicular to the ground) by gravity.

The bench portion 100 of the weight bench assembly 1 may be supported in an elevated position above first stationary unit 11 a second stationary unit 12 the by a first movable support 20 and a second movable support 21 wherein the first movable support 20 and second movable support 21 move with respect to the stationary units 11, 12. The first movable support 20 and the second movable support 21 may allow the bench portion 100 (for which they support) to be selectively locked in various tilt positions (FIG. 5) above the stationary units 11, 12 for performing various exercises. The first movable support 20 and the second movable support 21 may each have a plurality of holes 75 running along their respective lengths wherein the holes 75 receive extended pins 56, 66 as discussed below.

In an embodiment, at least one hinge 90 may be secured to the first stationary unit 11 and/or the second stationary unit 12 so that, if desired, even the first stationary unit 11 and the second stationary unit 12 may rotate upward approximately ninety degrees so that the entire weight bench assembly 1 may be secured in a cabinet 95 against a wall.

Figure 3:
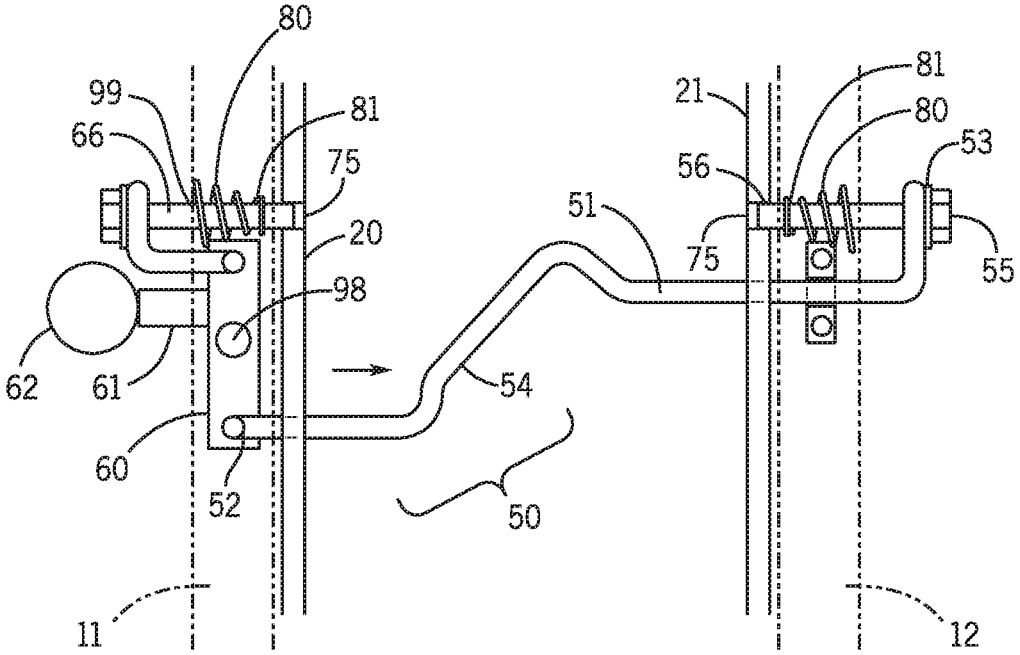
FIG. 3 illustrates a top view of the locking mechanism in the first orientation wherein the extended pins are in the locked position wherein the weight bench may not be adjusted.
Figure 4:
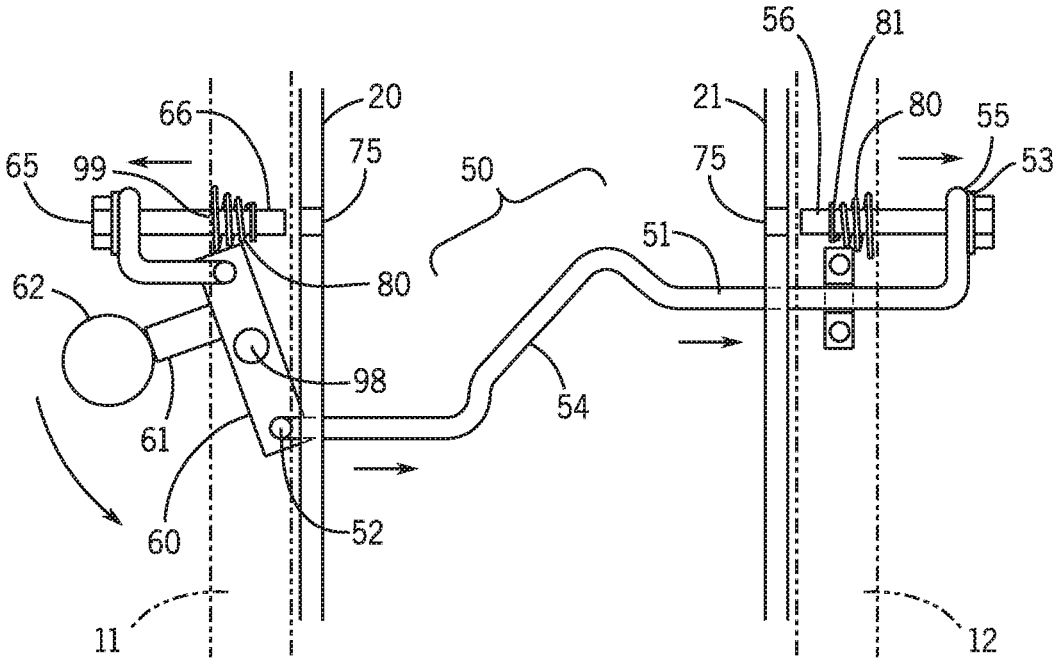
FIG. 4 illustrates a top view of the locking mechanism in the second orientation wherein the extended pins are in the unlocked position wherein the weight bench may be adjusted.

Referring now to FIGS. 3 and 4, in an embodiment, a locking mechanism 50 may be utilized to allow the bench portion 100 to be secured in various tilt positions as illustrated in FIG. 5. More specifically, the locking mechanism 50 may have a main bar 51 having a first end 52, a second end 53 and an extended bent portion 54 located between the first end 52 and the second end 53. The extended bent portion 54 may be bent upward away from the ground (as shown in FIG. 1) and may allow clearance for the leg bar 13 when the device 1 is in the vertical orientation of, for example, FIG. 9 when the leg bar 13 hangs downward by gravity.

In an embodiment, the first end 52 of the main bar 51 may be secured to a lever bar 60. The lever bar 60 may have a short shaft 61 which supports a handle 62. The handle 62 allows the user to move and control the locking mechanism 50. The second end 53 of the main bar 51 may be secured to a washer/nut combination 55 having an extended pin 56 which faces toward, and is partially located within the interior of the second stationary unit 12 by passing through a hollow channel 99 of the second stationary unit 12. The lever bar 60 may be connected to a second washer/nut combination 65 having a second pin 66 which partially extends within the interior of the first stationary unit 11 through a hollow channel 99.

In an embodiment, the main bar 51 may move from a first orientation as shown in FIG. 3 to a second orientation as shown in FIG. 4. In the first orientation of FIG. 3, the extended pins 56, 66 are secured within the holes 75 of the first movable support 20 and second movable support 21, after passing through the first and second stationary units 11, 12. When the extended pins 56, 66 are secured within the holes 75 of the movable supports 20, 21 (as shown in FIG. 3), the weight bench 1 is locked in place and the bench portion 100 may not move. In this locked position of FIG. 3, a user may utilize the apparatus 1 to lift weights in a safe manner.

In an embodiment, a spring 80 may be attached to the second pin 66. In particular, the spring 80 may have a terminal end 81 which, in one embodiment, is permanently secured to the pin 66. The spring 80 may be located within the interior of the first stationary unit 11. In the relaxed state of FIG. 3, the spring 80 pulls the second pin 66 into the opening 75 of the first movable support 20. When a user pulls the handle 62 outward and away from the second pin 66, the spring 80 gets compressed within the first stationary unit 11 and the second pin 66 leaves the opening 75 of the first movable support 20, as shown in FIG. 4. At the same time, the main bar 51 rotates at a pivot pin 98 and gets pushed toward the second movable support 21 and extended pin 56 gets pulled out of the opening 75 of the second movable support 21 (also shown in FIG. 4). The first and second movable supports 20, 21 may then be adjusted as is shown in FIG. 5. Once the proper angle adjustment is reached, the handle 62 is released and the spring 80 pulls the pins 56, 66 back into the openings 75 of the movable supports 20, 21 and the device 1 is again in the locked state and ready to be used. In an embodiment, the second pin 56 also has a spring 80 having a terminal end 81 that that is attached to the pin 56 wherein the spring 80 of the second pin 56 operates in substantially the same manner as the spring 80 of the first pin 66. In the compressed spring state of FIG. 4, the pins 56, 66 are located farther apart from each other than the relaxed spring state of FIG. 3.

Figure 2:
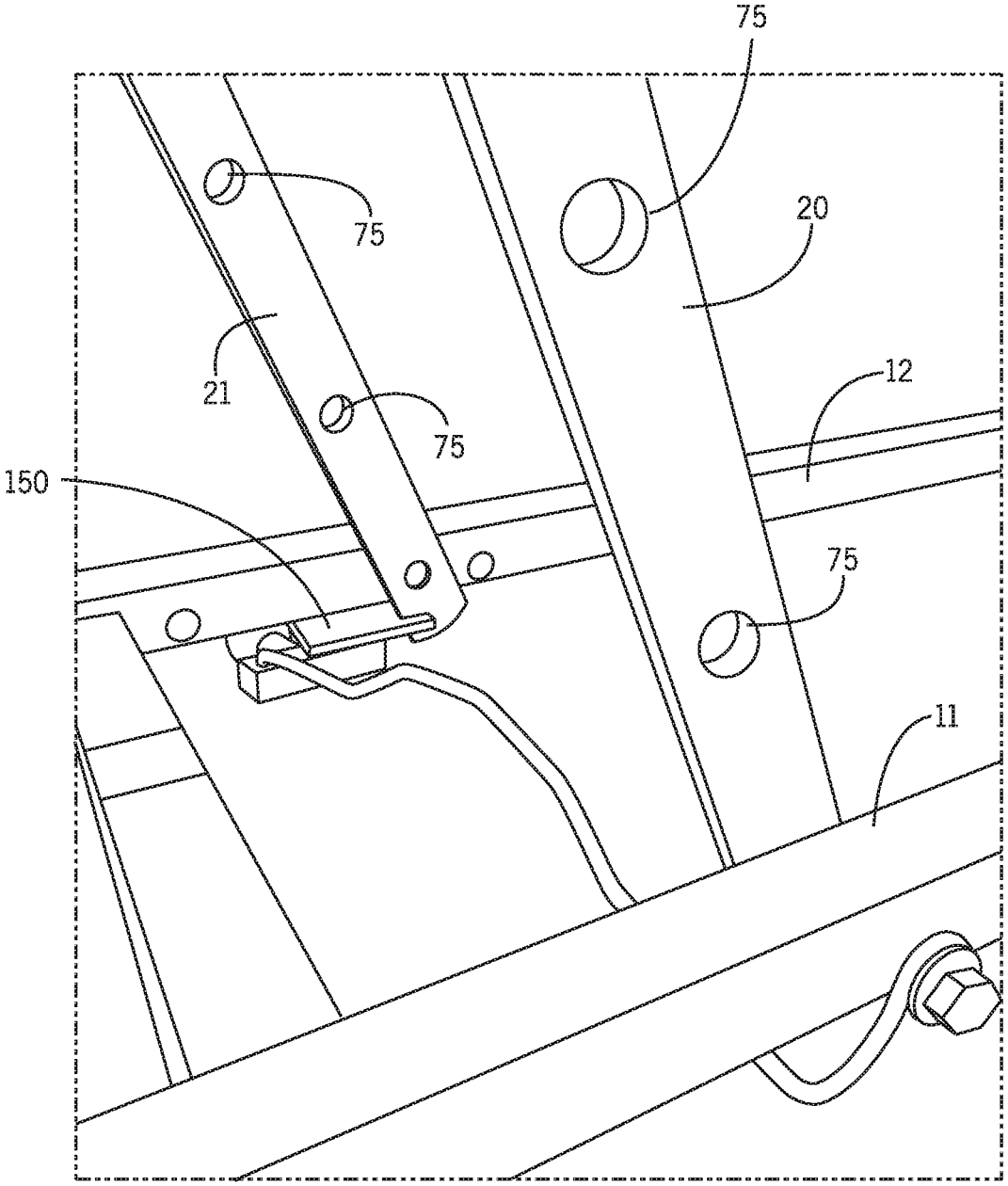
FIG. 2 illustrates a perspective view of the second side of the weight bench having the tilt locking mechanism.
Figure 6:
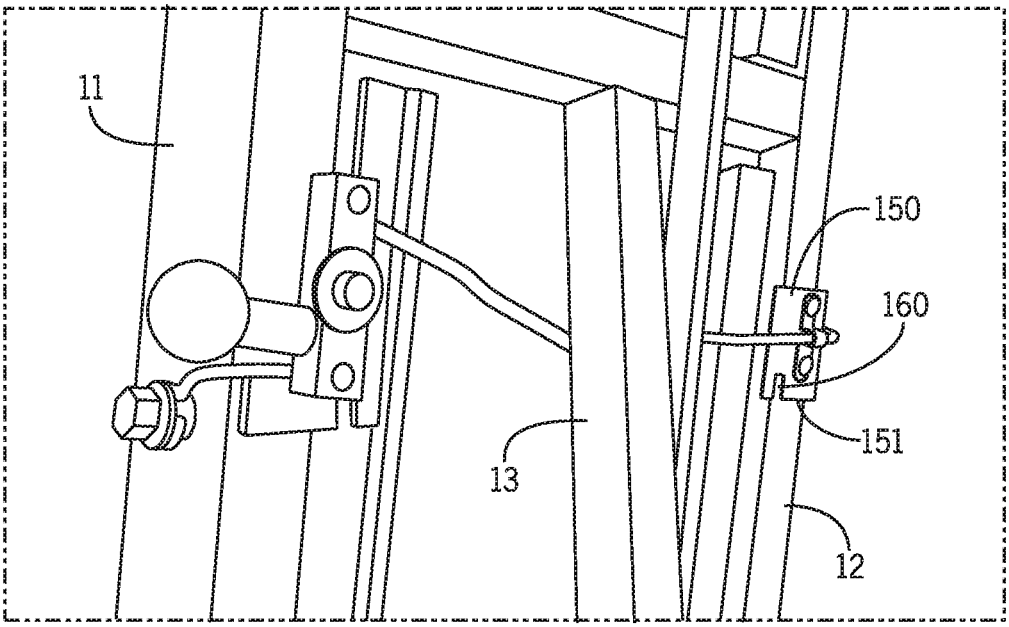
FIG. 6 illustrates an underside of the weight bench.
Figure 7:
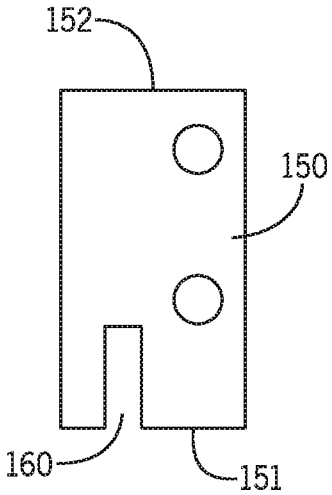
FIG. 7 illustrates the pivot plate of the weight bench.

In an embodiment, a pivot plate 150 (FIGS. 2, 6 and 7) may be used to allow the first movable support 20 and the second movable support 21 to pivot with respect to the first stationary unit 11 and the second stationary unit 12 in the proper manner. More specifically, the pivot plate 150 may have a first end 151 and a second end 152. The first end 151 of the pivot plate 150 may have an opening slot 160. The opening slot 160 may have a width with is slightly greater than the width of the second movable frame unit 20 so that the first movable frame unit 20 may be located partly within the slot 160 and may allow the second movable frame unit 20 slide to different positions as illustrated in FIG. 5. A second pivot plate may be located on the first stationary unit 11 and may operate in the same manner as the pivot plate 150 of FIG. 7.

Figure 10:
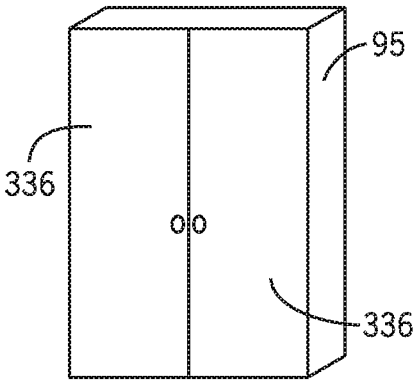
FIG. 10 illustrates the weight bench secured concealed within the cabinet.
Figure 8:
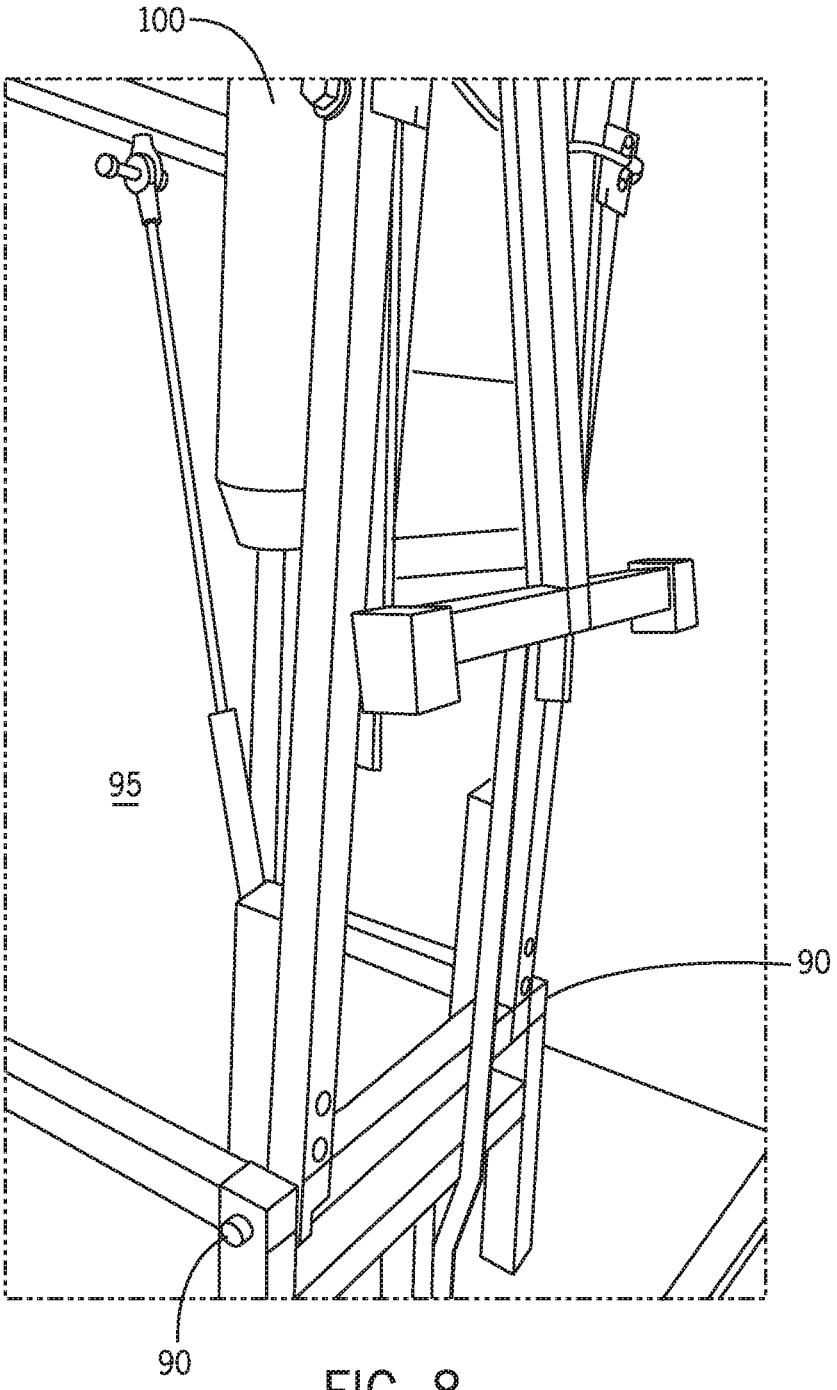
FIG. 8 illustrates a view of the underside of the apparatus while the apparatus is lifted upward within the cabinet.
Figure 9:
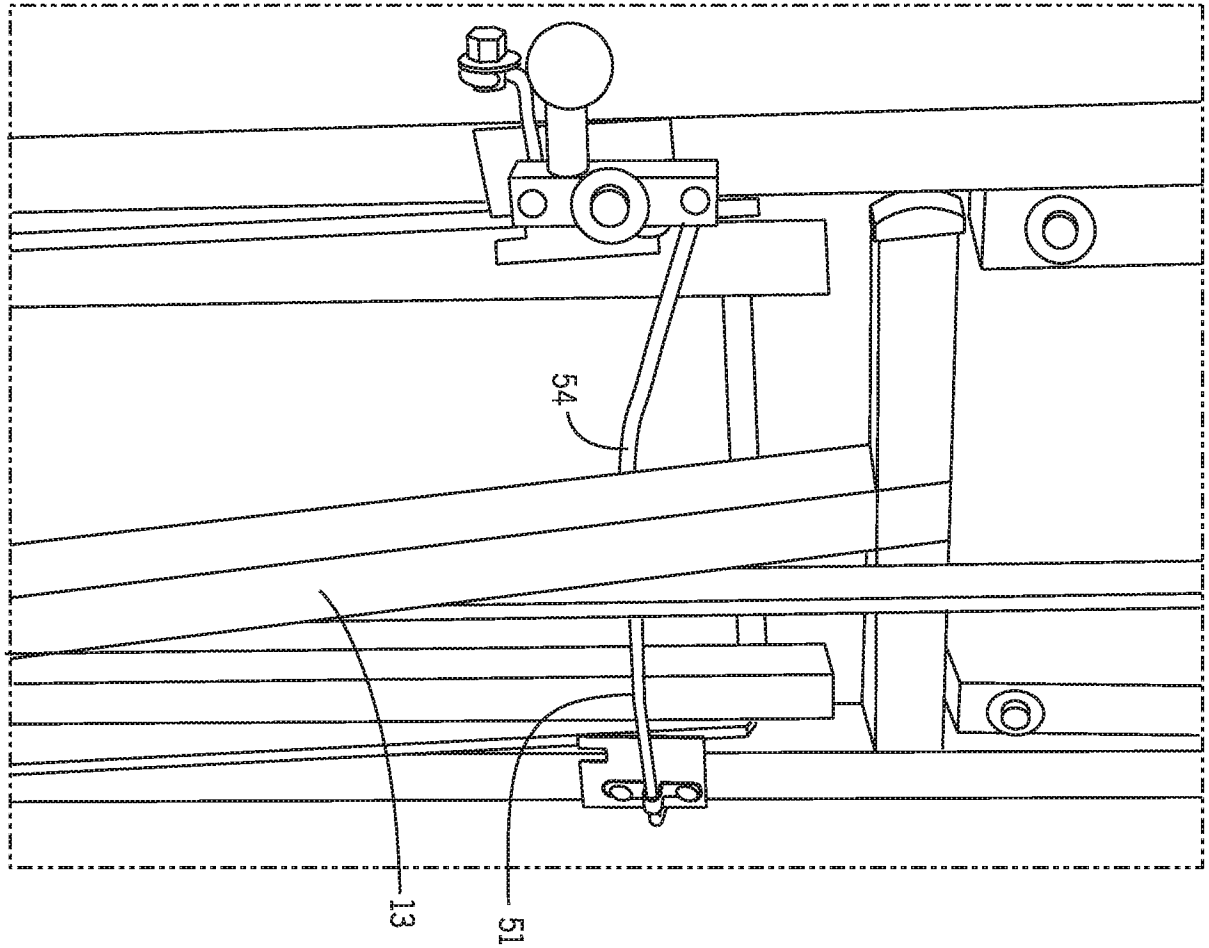
FIG. 9 illustrates a view of the underside of the apparatus while the apparatus is lifted upward within the cabinet.

Referring now to FIGS. 8-10, in an embodiment, as stated above, the weight bench 1 may tilt upward into a cabinet 95 for storage when not in use. In this orientation, the leg bar 13 becomes generally parallel with the bench 100 and both hang downward at a right angle with respect to the floor. In an embodiment, doors 336 of the cabinet 95 may be shut concealing the weight bench 1.

In an embodiment, the first stationary unit 11 and second stationary unit 12 remain parallel at all times with respect to each other while the first movable frame support 20 and the second movable frame support 21 remain parallel to each other at all times. It should be understood from the drawings that the first stationary unit 11 and second stationary unit 12 are 'stationary' and parallel to the ground when the bench is being used during exercise, but those units 11, 12 actually rotate upward for storage. Further, the first movable frame support 20 and the second movable frame support 21 may be locked in and located at different locations (and thus are 'movable') during actual use of the bench during exercise. While in the storage position (in the cabinet 95) or while in the completely flat position for a standard bench press, all four units 11, 12, 20, and 21 are parallel to each other.

In an embodiment in the storage position, the leg bar 13 is generally parallel to the four main units 11, 12, 20, 21 in the vertical position, but in the usable exercise position the leg bar 13 is perpendicular to the first stationary unit 11 and second stationary unit 12 and the ground. The leg bar 13 may become generally parallel to the four main units 11, 12, 20 and 21 in the vertical position in the cabinet 95 as a result of the extended bent portion 54 of the main bar 51 curving inward toward the back of the cabinet 95 therein allowing room for the leg bar 13 to fold downward into the generally vertical position without hitting the main bar 51. The leg bar 13 may pivot at a pin (not shown) and may generally remain always perpendicular to the floor via gravity (in both the cabinet 95 orientation and while in use as a weight bench).

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A weight bench comprising:

a first frame member having a top, a bottom, a first side, a second side and at least one hollow channel;

a second frame member having a top, a bottom, a first side, a second side and at least one hollow channel;

a first movable bar having a top surface and at least one opening;

a second movable bar having a top surface and at least one opening;

a first locking pin passing through one of the at least one hollow channel of the first frame member and capable of entering one of the at least one opening of the first movable bar and capable of locking the first movable bar in at least a first and a second position with respect to the first frame member;

a first spring surrounding the first locking pin wherein the first spring becomes compressed when the first locking pin is removed from the one of the at least one opening of the first movable bar and wherein the first spring is less compressed when the first locking pin is located within the one of the at least one opening of the first movable bar;

a bench located on the top surface of the first movable bar;

a second locking pin passing through the second frame member and capable of entering one of the at least one opening of the second movable bar and capable of locking the second movable bar in at least a first and a second position with respect to the second frame member; and wherein the first locking pin and the second locking pin concurrently both move either toward or away from each other by activating a handle and are incapable of moving in a same direction.

2. The weight bench of claim 1 wherein the first spring has a first end and a second end and wherein the second end of the first spring is permanently attached to the first locking pin.

3. The weight bench of claim 1 wherein the at least one opening of the first movable bar has a plurality of openings, and wherein the first locking pin may be inserted into any of the plurality of openings of the first movable bar.

4. The weight bench of claim 1 wherein the at least one opening of the second movable bar has a plurality of openings, and wherein the second locking pin may be inserted into any of the plurality of openings of the second movable bar.

5. The weight bench of claim 1 further comprising:

a main locking bar connected to the first frame member and the second frame member wherein the main locking bar moves from a first main locking bar position to a second main locking bar position with respect to the first frame member and the second frame member and wherein the first locking pin is connected to the main locking bar through a movable lever bar.

6. The weight bench of claim 5 further comprising:

a pivot pin connected to the movable lever bar wherein the pivot pin allows the movable lever bar to rotate and therein move both the first locking pin and the main locking bar.

7. The weight bench of claim 5 wherein the main locking bar has a bent portion which renders it non-linear.

8. The weight bench of claim 1 further comprising:

a rotating leg wherein the rotating leg supports a weight of the weight bench.

9. The weight bench of claim 1 further comprising:

a pivot plate attached to the second frame member wherein the pivot plate has an indentation for receiving the second movable bar and wherein the indentation of the pivot plate restricts a movement of the second movable bar.

10. A weight bench comprising:

a first frame member having a top, a bottom, a first side, a second side and at least one hollow channel;

a second frame member having a top, a bottom, a first side, a second side and at least one hollow channel;

a first movable bar having a top surface and at least one opening;

a second movable bar having a top surface and at least one opening;

a first locking pin passing through one of the at least one hollow channel of the first frame member and capable of entering one of the at least one opening of the first movable bar and capable of locking the first movable bar in at least a first and a second position with respect to the first frame member;

a first spring surrounding the first locking pin wherein the first spring becomes compressed when the first locking pin is removed from the one of the at least one opening of the first movable bar and wherein the first spring is less compressed when the first locking pin is located within the one of the at least one opening of the first movable bar;

a bench located on the top surface of the first movable bar; and a main locking bar connected to the first frame member and the second frame member wherein the main locking bar moves from a first main locking bar position to a second main locking bar position with respect to the first frame member and the second frame member and wherein the first locking pin is connected to the main locking bar through a movable lever bar.

11. The weight bench of claim 10 further comprising:

a pivot pin connected to the movable lever bar wherein the pivot pin allows the movable lever bar to rotate and therein move both the first locking pin and the main locking bar.

12. The weight bench of claim 10 wherein the main locking bar has a bent portion which renders it non-linear.

* * * * *